US007492086B1

(12) United States Patent
Cathey et al.

(10) Patent No.: US 7,492,086 B1
(45) **Date of Patent: *Feb. 17, 2009**

(54) LOW WORK FUNCTION EMITTERS AND METHOD FOR PRODUCTION OF FED'S

(75) Inventors: David A. Cathey, Boise, ID (US); Surjit S. Chadha, Meridian, ID (US); Behnam Moradi, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/489,286

(22) Filed: Jan. 21, 2000

Related U.S. Application Data

(62) Division of application No. 09/105,613, filed on Jun. 26, 1998, now Pat. No. 6,057,638, which is a division of application No. 08/543,819, filed on Oct. 16, 1995, now Pat. No. 5,772,488.

(51) Int. Cl.
*H01J 1/02* (2006.01)
*H01J 63/04* (2006.01)

(52) U.S. Cl. ..... 313/495; 313/309; 313/310; 313/336; 313/351

(58) Field of Classification Search ..... 313/311, 313/309, 306, 351, 495, 352
See application file for complete search history.

(56) References Cited

U.S. PATENT DOCUMENTS 4,325,000 A 4/1982 Wolfe et al.
4,940,916 A 7/1990 Borel et al.
5,089,292 A * 2/1992 MaCaulay et al. ..... 427/78
5,186,670 A 2/1993 Doan et al.
5,210,472 A 5/1993 Casper et al.
5,229,331 A 7/1993 Doan et al.
5,302,238 A * 4/1994 Roe et al. ..... 216/11

(Continued)

FOREIGN PATENT DOCUMENTS

JP 1-235124 9/1989

OTHER PUBLICATIONS

Macaulay, Cesiation of Field Emission Microcathode Arrays, Sixth International Vacuum Microelectronics Conference, IEEE, Electron Devices Society, Technical Digest, Jul. 12-15, 1993, p. 166.

(Continued)

*Primary Examiner*—Ashok Patel
(74) *Attorney, Agent, or Firm*—TraskBritt

(57) ABSTRACT

According to one aspect of the invention, a field emission display is provided comprising: an anode; a phosphor screen located on the anode; a cathode; an evacuated space between the anode and the cathode; an emitter located on the cathode opposite the phosphor; wherein the emitter comprises an electropositive element both in a body of the emitter and on a surface of the emitter. According to another aspect of the invention, a process for manufacturing a FED is provided comprising the steps of forming an emitter comprising an electropositive element in the body of the tip; positioning the emitter in opposing relation to a phosphor display screen; creating an evacuated space between the emitter tip and the phosphor display screen; and causing the electropositive element to migrate to an emission surface of the emitter.

7 Claims, 2 Drawing Sheets

U.S. PATENT DOCUMENTS

| | | | | | |
|---|---|---|---|---|---|
| 5,358,908 | A | | 10/1994 | Reinberg et al. | |
| 5,391,259 | A | | 2/1995 | Cathey et al. | |
| 5,469,014 | A | * | 11/1995 | Itoh et al. | 313/308 |
| 5,532,177 | A | * | 7/1996 | Cathey | 438/20 |
| 5,772,488 | A | | 6/1998 | Cathey et al. | |
| 6,057,638 | A | | 5/2000 | Cathey et al. | |
| 6,515,414 | B1 | * | 2/2003 | Cathey et al. | 313/495 |
| 6,825,596 | B1 | * | 11/2004 | Cathey | 313/336 |
| 7,064,476 | B2 | * | 6/2006 | Cathey | 313/336 |

OTHER PUBLICATIONS

Bauch et al. Apr. 1989 "Effect of Cs Contamination on the Interface State Density of Mnos Capacitors," Applied Surface Science 39:356-363.

Branston et al. Oct. 1991 "Field Emission from Metal-Coated Silicon Tips," IEEE Transaction on Electron Devises, vol. 38, No. 10, pp. 2329-2333.

Ea et al. Jul. 1990 "Avalanche Electron Emission Cathode Array," Vacumme Microelectronics Conference.

Evtukh et al. Jul. 30, 1995, "Parameters of the Tip Arrays Covered by Low Work Function Layers," Institute of Semiconductor Physics Academy of Sciences, Prospect Nauki 45, Kiev-252028, Ukraine (Aug. 1995).

Evtukh, et al. "Parameters of the Tip Arrays Covered by Low Work Function Layers," J. Vac. Sci Tech. B 14 (3), pp. 2130-2134, (Pub. May-Jun. 1996).

Macaulay et al. Aug. 24, 1992 "Ceslated thin-film field-emission microcathode arrays," Appl. Phys. Lett., vol. 61, No. 8, pp. 997-999.

Michaelson H.B Jan. 1978 "Relation Between an Atomic Electronegativity Scale and the Work Function," IBM J. Res. Develop, vol. 22, No. 1, pp. 72-80.

* cited by examiner

LOW WORK FUNCTION EMITTERS AND METHOD FOR PRODUCTION OF FED'S

CROSS-REFERENCE TO RELATED APPLICATIONS

This application is a divisional of U.S. patent application Ser. No. 09/105,613, filed Jun. 26, 1998, now U.S. Pat. No. 6,057,638, issued May 2, 2000, which is a divisional application of U.S. patent application Ser. No. 08/543,819, filed Oct. 16, 1995, now U.S. Pat. No. 5,772,488, issued Jun. 30, 1998, the contents of which are hereby expressly incorporated by reference for all purposes.

This invention was made with government support under Contract No. DABT 63-93-C0025 awarded by Advanced Research Projects Agency (ARPA). The government has certain rights in this invention.

BACKGROUND OF THE INVENTION

This invention relates to field emission displays and, more particularly, to the formation of low work function emitters.

The required turn-on voltage for an emitter at a constant current is a function of the work function of the material at the surface of the emitter. For example, see U.S. Pat. No. 4,325,000, issued Apr. 13, 1982, incorporated herein by reference, and H. B. Michaelson, "Relation Between An Atomic Electronegativity Scale and the Work Function," 22 IBM Res. Develop., No. 1, January 1978. Reduction of the work function of a material can be achieved by coating the surface with an electropositive element. For example, see U.S. Pat. No. 5,089,292, incorporated herein by reference. However, such knowledge has never been translated into a useful field emission display. Electropositive materials are very reactive and, therefore, upon coating on an emitter, they quickly begin to react with most atmospheres, resulting in a high work function material coating the emitter. Accordingly, emitters coated with low work function materials on the surface have traditionally not been useful. Also, the compositions in which electropositive elements normally exist (for example, as a salt with Cl) include elements that have a very large work function (e.g., Cl).

The present invention provides solutions to the above problems.

SUMMARY OF THE INVENTION

According to one aspect of the invention, a field emission display is provided comprising: an anode; a phosphor located on the anode; a cathode; an evacuated space between the anode and the cathode; an emitter located on the cathode opposite the phosphor, wherein the emitter comprises an electropositive element, both in a body of the emitter and on a surface of the emitter.

According to another aspect of the invention, a process for manufacturing a FED is provided comprising the steps of: forming an emitter comprising an electropositive element in the body of the tip; positioning the emitter in opposing relation to a phosphor display screen; creating an evacuated space between the emitter tip and the phosphor display screen; and causing the electropositive element to migrate to an emission surface of the emitter.

DESCRIPTION OF THE DRAWINGS

For a more complete understanding of the present invention and for further advantages thereof, reference is made to the following Detailed Description taken in conjunction with the accompanying drawings, in which.

It is to be noted, however, that the appended drawings illustrate only typical embodiments of this invention and are, therefore, not to be considered limiting of its scope, for the invention may admit to other equally effective embodiments.

DETAILED DESCRIPTION

Figure 1:
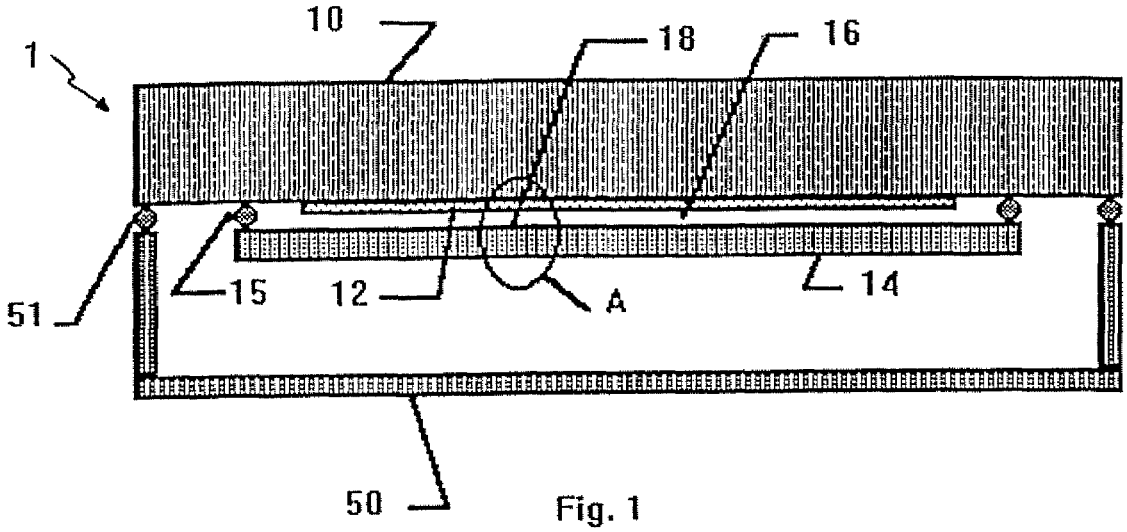
FIG. 1 is a side view of an embodiment of the present invention.

Referring now to FIG. 1, a field emission display 1 according to the present invention is shown comprising: an anode 10, which in this embodiment comprises a faceplate, or screen of the field emission display. This embodiment further comprises a phosphor screen 12, located on the anode 10; a cathode 14, attached to anode 10 by glass frit 15; and an evacuated space 16 between the anode 10 and the cathode 14.

Figure 2:
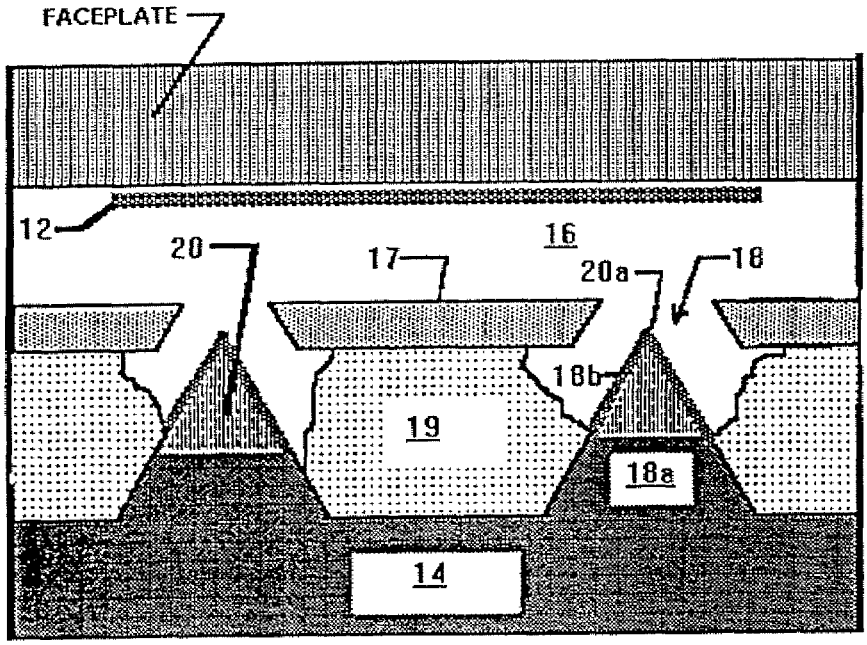
FIG. 2 is a side view of a detailed area of FIG. 1.

Referring now to FIG. 2, a more detailed view of cathode 14 in the region of circle A of FIG. 1 is seen comprising: an emitter tip 18 located on the cathode 14 opposite the phosphor screen 12. In this embodiment of the invention, the emitter tip 18 comprises an electropositive element 20 both in a body 18*a* of the emitter tip 18 and on a surface 18*b* of the emitter tip 18. Spaced from emitter tip 18 by dielectric 19 is grid electrode 17. In this embodiment, the distribution of the electropositive element 20 in the body 18*a* of the emitter tip 18 is substantially even. However, according to an alternative embodiment, the distribution may be more uneven, wherein there may be a gradient of the electropositive element 20 in the body 18*a* and the surface 18*b* is substantially all electropositive element 20. According to one specific embodiment, the distribution is an exponential change, and the electropositive element 20 is provided in the body 18*a* such that the work function of the surface 18*b* of emitter tip 18 is reduced by at least 50%. For example, in the case of an amorphous silicon emitter tip, the work function is 3.9 eV without an electropositive component, and about 2.0 eV if Na is doped according to the dip process described below.

Acceptable specific elements for electropositive element 20 are chosen from groups IA, IIA, IIIA and IIIB of the periodic table. One specific element known to be useful as electropositive element 20 comprises Cs. Another element known to be useful comprises Na. Others known or believed to be useful comprise: H, Li, Be, B, Mg, Al, Ga, Ba, Rb, Ca, K, Sr, and In.

An example process for manufacturing a field emission display ("FED") according to the present invention comprises the steps of: forming an emitter tip 18 comprising an electropositive element 20 in the body 18*a* of the emitter tip 18; positioning the emitter tip 18 in opposing relation to a phosphor screen 12 on the display; creating an evacuated space 16 between the emitter tip 18 and the phosphor screen 12; causing the electropositive element 20 to migrate to the emission surface 18*b* of the emitter tip 18, whereby the display of FIG. 2 results.

According to an example process of forming the emitter tip as in FIG. 2, the emitter tip 18 is formed by methods that will be understood by those of skill in the art (for example, see U.S. Pat. Nos. 4,940,916; 5,391,259; and 5,229,331, all of which are incorporated herein by reference), and the substrate with the emitter tip 18 is contacted with a solution in a glass container. The solution comprises an electropositive element as the solute, and a solvent (for example, alcohol). Other solvents believed to be useful according to other embodiments of the invention include: water, acetone, or any other solvent capable of dissolving electropositive salts.

As mentioned above, said electropositive element comprises an element chosen from groups IA, IIA, IIIA and IIIB of the periodic table. One specific element known to be useful as an electropositive element comprises Cs. Others known or believed to be useful comprise: H, Li, Be, B, Na, Mg, Al, Ga, Ba, Rb, Ca, K, Sr, and In.

According to one example of the present invention, the contacting comprises dipping the emitter tip into the solution for a time sufficient to cause $10^{21}$ atoms/$cm^3$ of electropositive material to penetrate into the emitter tip. Some acceptable solutions, dip times, and dip temperatures are listed below (other examples will occur to those of skill in the art):

| Solution Composition | Dip Time | Dip Temperature (Degrees C.) |
|---|---|---|
| propan-1-ol solvent - NaCl solute | 15 minutes | 82 |
| methanol solvent - CsCl solute | 15 minutes | 62 |
| ethanol solvent - NaCl solute | 15 minutes | 75 |
| methanol solvent - NaCl solute | 15 minutes | 62 |
| propan-1-ol solvent - CsCl solute | 15 minutes | 82 |
| ethanol solvent - CsCl solute | 15 minutes | 75 |

In a more specific embodiment, a silicon substrate from which the emitters have been shaped is dipped in a solution of propan-2-ol, as the solvent, and CsCl, the solution being kept just under the boiling temperature. Next, either amorphous silicon (a-Si) or micro crystalline silicon (u-Si) is deposited at between about 200 degrees C. and about 300 degrees C. (for example, by plasma-enhanced chemical vapor deposition). Thus, the Cs layer is protected from reaction with other elements by the silicon deposition during further handling. Once the display is ready for assembly, the various components of FIG. 1 are brought together in a vacuum, and then sealed and heated. Since in a-Si and u-Si the density of surface states is high, most of the Cs atoms will migrate to the surface of emitter tip 18 and be trapped right at the surface of the deposited films, where a cesium rich monolayer 20*a* is created, as shown in FIG. 2.

In another specific embodiment, a glass substrate with 7000 angstrom amorphous-silicon emitters formed thereon was dipped in a solution of propan-1-ol, as the solvent, and NaCl for 15 minutes at a temperature just below boiling. The result was an approximately 7000 angstrom alpha-silicon/glass structure with Na doped therein. SIMS analysis of H, P, and Na were conducted comparing a similar sample that had not been dipped. The NaCl dipped structure had about 500 times higher Na near the Si surface (at about 500 angstroms depth) than the sample that had not been dipped. The Na level remained higher throughout the 7000 angstroms tested, but decreased to about 80 times higher near the Si/glass interface (at about 6000 angstroms). Further, the dipped sample included a slightly higher P than the undipped sample, but the difference was less than about 1.5 times. No H difference was seen between the samples. Mo contamination (due to use of a furnace having Mo therein) was detected on the NaCl dipped sample, but no Mo was seen in the undipped sample. Mo contamination is avoided in other embodiments. Higher K and Ca were also observed in the NaCl dipped sample. Surprisingly, Cl was not detected in either the dipped or undipped sample. This is an important finding as Cl has a high work function and is undesirable in the emitter tip.

According to a further embodiment, the emitter tip is made after the substrate from which the emitter tip is formed is doped with an electropositive element. For example, according to one alternative embodiment of the invention, the substrate on which the emitter tip is manufactured is dipped, before the formation of the emitter tip, and the emitter tip is then formed on the substrate. According to specific examples of processes believed to be acceptable according to this embodiment, the following parameters are used:

| Solution Composition | Dip Time | Dip Temperature (Degrees C.) |
|---|---|---|
| propan-1-ol solvent - NaCl solute | 15 minutes | 82 |
| methanol solvent - CsCl solute | 15 minutes | 62 |
| ethanol solvent - NaCl solute | 15 minutes | 75 |
| methanol solvent NaCl solute | 15 minutes | 62 |
| propan-1-ol solvent - CsCl solute | 15 minutes | 82 |
| ethanol solvent - CsCl solute | 15 minutes | 75 |

According to a further embodiment, plasma-enhanced chemical vapor deposition is used to place the electropositive element in the body of the emitter tip. As before, the vapor deposition is conducted either before or after the formation of the emitter tip. After the vapor deposition, heating will cause diffusion of the electropositive element into the body of the emitter tip. After assembly in an evacuated space, subsequent heating causes the material to migrate to the surface of the emitter tip, where it will not react due to the vacuum, and a low work function emitter tip is thereby achieved.

Another acceptable method of placement of the electropositive element in the body of the emitter tip is through ion-implantation, again followed by heating after evacuation to cause diffusion.

In embodiments in which the electropositive element is applied before the emitter tip is formed, some of the electropositive element will be exposed during subsequent steps, such as etching. When this occurs, an oxide or non-volatile salt will form, depending upon the atmosphere at the surface of the emitter tip when exposure occurs. In these embodiments, the oxide or non-volatile salt is rinsed, for example, with buffered oxide etchant in the case of oxide or water in the case of salt, before further processing. Acceptable examples of materials for the substrate that is doped with the electropositive element include, for example, Si, Mo, Cr, and W. Others will occur to those of skill in the art.

Other steps to form the emitter tip and other structures of the FED will be understood by those of skill in the art and require no further explanation here.

Figure 3:
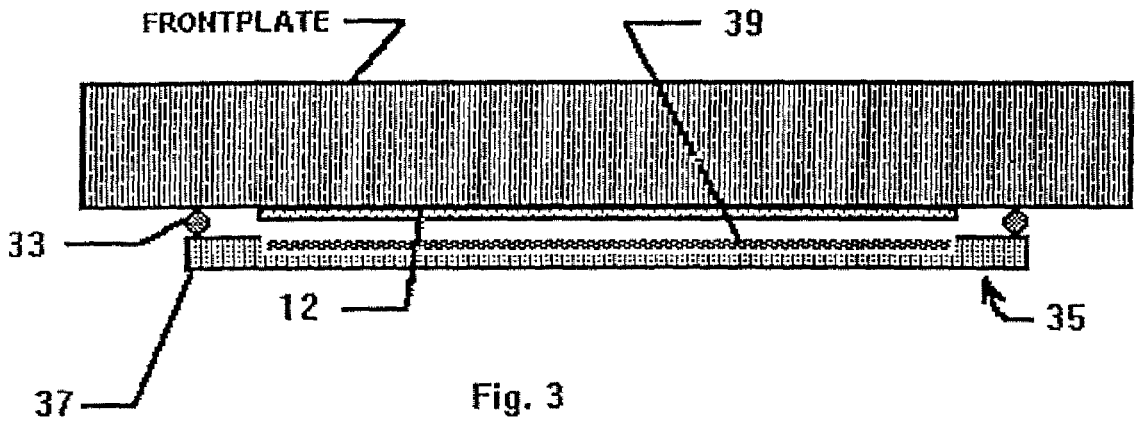
FIG. 3 is a side view of an alternative embodiment of the invention as seen in FIG. 1.

According to some embodiments (for example, see FIG. 3), the display is sealed by glass frit seal 33, chosen to match the thermal expansion characteristic of the cathode 35, which, in this embodiment, comprises a glass substrate 37 on which emitters 39 are formed. This embodiment is particularly useful for large area displays. The sealing is done in a vacuum space by heating the entire device. The heating to a seal temperature for the frit 33 (for example, 450 degrees C. for a lead-based glass frit) causes the migration of the electropositive element 20 (see FIG. 2) to the surface of the emitters 39.

According to a further embodiment, seen in FIG. 1, the cathode 14 is encased by a backplate 50, which is also sealed in vacuum by a frit 51 by heating. This embodiment is useful in small area displays where, for example, the cathode 14 comprises a silicon substrate onto which the emitter tips 18 are formed. Here, the cathode 14 is attached to faceplate 10 by another glass frit seal 15, also sealed by heating.

What is claimed is:

1. A field emission display comprising:

an anode;

a cathode;

the anode and the cathode sealed together and spaced apart to define an evacuated space therebetween; and a plurality of electron emitters protruding from a surface of the cathode, each of the emitters having a tip for emitting electrons to the anode comprising silicon and having an electropositive element distributed throughout a body and at a surface thereof.

2. The field emission display of claim 1, wherein the electropositive element is substantially evenly distributed throughout the body.

3. The field emission display of claim 1, wherein the electropositive element is an element selected from the group consisting of Group IA of the periodic table.

4. The field emission display of claim 1, wherein the electropositive element comprises Cs.

5. The field emission display of claim 1, wherein the electropositive element is an element selected from the group consisting of H, Li, Be, B, Na, Mg, Al, Ga, Ba, Rb, Ca, K, Sr, and In.

6. The field emission display of claim 1, wherein the electropositive element is an element selected from the group consisting of Group IIA of the periodic table.

7. The field emission display of claim 1, wherein the electropositive element is an element selected from the group consisting of Group IIIA of the periodic table.

* * * * *

UNITED STATES PATENT AND TRADEMARK OFFICE

CERTIFICATE OF CORRECTION

PATENT NO. : 7,492,086 B1
APPLICATION NO. : 09/489286
DATED : February 17, 2009
INVENTOR(S) : Cathey et al.

It is certified that error appears in the above-identified patent and that said Letters Patent is hereby corrected as shown below:

On the Title page, in field (54), in "Title", in column 1, lines 1-2, delete "LOW WORK FUNCTION EMITTERS AND METHOD FOR PRODUCTION OF FED'S" and insert -- A FIELD EMISSION DISPLAY WITH LOW WORK FUNCTION EMITTERS --, therefor.

On the Title page, in field (57), under "Abstract", in column 2, line 9, delete "of" and insert -- of: --, therefor.

In column 1, lines 1-2, delete "LOW WORK FUNCTION EMITTERS AND METHOD FOR PRODUCTION OF FED'S" and insert -- A FIELD EMISSION DISPLAY WITH LOW WORK FUNCTION EMITTERS --, therefor.

In column 1, line 13, below "purposes." insert -- GOVERNMENT RIGHTS --, as the heading of the below given paragraph.

Signed and Sealed this

Twenty-first Day of April, 2009

John Doll

JOHN DOLL
*Acting Director of the United States Patent and Trademark Office*